US005201848A

United States Patent [19]

Powers

[11] Patent Number: 5,201,848

[45] Date of Patent: Apr. 13, 1993

[54] DEEP WELL ELECTRICAL SUBMERSIBLE PUMP WITH UPLIFT GENERATING IMPELLER MEANS

[75] Inventor: Maston L. Powers, Oklahoma City, Okla.

[73] Assignee: Conoco Inc., Ponca City, Okla.

[21] Appl. No.: 770,071

[22] Filed: Oct. 1, 1991

[51] Int. Cl.[5] ..... F04D 29/54

[52] U.S. Cl. ..... 415/199.1

[58] Field of Search ..... 415/170.1, 198.1, 199.1, 415/199.2, 901, 171.1

[56] References Cited

U.S. PATENT DOCUMENTS

| | | | |
|---|---|---|---|
| 768,911 | 8/1904 | Schoene | 415/171.1 |
| 2,228,207 | 1/1941 | Forssell | 415/198.1 |
| 4,872,808 | 10/1989 | Wilson | 415/901 |
| 5,076,757 | 12/1991 | Dorsch | 415/171.1 |

*Primary Examiner*—Richard A. Bertsch

*Assistant Examiner*—Roland McAndrews

*Attorney, Agent, or Firm*—John E. Holder

[57] ABSTRACT

An electrical downhole centrifugal pump for pumping fluids from a deep well includes a relatively small diameter pump housing which is suspended from a tubing string and including a series of impellers and diffusers. The impellers are mounted on a vertical shaft connected to a motor for driving the impellers relative to the diffusers on the housing. Upper and lower shrouds enclose the top and bottom surfaces of impeller blades rotating with the shaft. A first group of impellers are arranged to move freely longitudinally on the shaft while a second group are fixed to the shaft to prevent relative longitudinal motion. A lifting vane is formed on the outer surface of the upper shroud on the impellers which are fixed to the shaft. A net lifting force is thus applied to the shaft by those impellers of the second group having upthrust impellers to diminish the load carried by a pump shaft thrust bearing.

18 Claims, 5 Drawing Sheets

DEEP WELL ELECTRICAL SUBMERSIBLE PUMP WITH UPLIFT GENERATING IMPELLER MEANS

BACKGROUND OF THE INVENTION

Field of the Invention

This invention relates to a deep well electrical submersible pump and in particular to a pump for pumping fluids from a relatively small diameter wellbore under high load conditions.

When pressures in an oil reservoir have fallen to the point where a well will not produce at its most economical rate by natural energy, some method of artificial lift is employed. One of the lifting methods employed in such situations is that of a submersible electrical pump which is an especially built centrifugal pump, the shaft of which is directly connected to an electric motor. The entire unit is sized so that it may be lowered into the well on a pipe string commonly called tubing, to the desired operating depth. In operation, the motor causes the pump to rotate so that impellers in the pump apply centrifugal forces to the fluids entering the pump intake. The pump is installed on the production tubing below the fluid level in the wellbore. Since both the pump and the pump motor are submerged in the well fluid, electric current is supplied through a special heavy duty armored cable. The total pressure developed by such a pump forces fluid up the tubing string to the surface. The capacity of this type of pump can range from 200 to 26,000 barrels a day depending upon the depth from which the fluid is lifted and the size of the wellbore casing which determines the maximum diameter of the pump.

The electric submersible pump (ESP) is perhaps the most versatile of the major oil production artificial lift methods. ESPs are used to produce a variety of fluids and the gas, chemicals, and contaminants commonly found in these fluids. Currently ESPs are operated economically in virtually every known oil field environment. Relatively high gas fluid ratios can be handled using tapered designed pumps and/or a special gas separator pump intake. An ESP can be operated in a deviated or directionally drilled well. Although the recommended operating position is in a straight section, the ESP can operate in a horizontal position. ESPs have efficiently lifted fluids in wells deeper than 12,000 feet. The pumps can be operated in casings as small as 4.5 inches OD. Many studies indicate that ESPs are the most efficient lift method and the most economical on a cost per lifted barrel basis. The ESP historically has been applied in lifting water or low oil cut wells that perform similar to water wells. These pumps are typically constructed with impellers being mounted either fixed or floating on a vertical shaft, which when rotated, centrifugally force fluids outwardly and upwardly through a multiplicity of impeller diffuser stages to sequentially lift fluid to the surface. In effect, the stages of the pump sequentially pressurize the fluid so that the aggregate pressure increase can overcome the hydrostatic head within the fluid column above the pump and thus eventually move the fluids to the surface. These pumps are designed to minimize the effect of hydrostatic pressures in the wellbore on the pump parts. This is typically done by the utilization of balancing hubs or drums to minimize forces within the pump to prevent any unnecessarily high forces from being imparted to the parts thereof which would in turn impose high frictional forces on the moving parts therein to generate excessive wear of the parts. The hydrostatic forces which are encountered at the pump level in such a well typically are a result of the height of the fluid column in the tubing string above the pump which is acting down upon the pump parts. In a large diameter wellbore it is possible to use a pump of sufficient diameter to employ a large thrust bearing. Such a large thrust bearing is capable of absorbing greater loads which may be imposed upon the pump. However, in a small diameter bore hole, the thrust-bearing size is compromised to the extent that it may not be sufficient to withstand the downward forces exerted upon the pump shaft in deep well applications. In this case such forces acting on the pump parts may generate wear to the extent that such a pump system is impractical.

One design which has been used to overcome this problem of excess force on the pump shaft, is that of a bottom floater pump. In such a pump, impellers on the upper end of the pump are fixed to the pump shaft. Therefore, a portion of the load on the pump shaft due to hydrostatic pressure acting on the cross-sectional area of the shaft, is transmitted to the impellers fixed on the shaft. The impellers in turn have thrust washers which engage mating surfaces on the diffusers which in turn are connected to the pump housing so that the load of the pump shaft is partially absorbed eventually by the pump housing, which is carried by the tubing string thus relieving the load on the thrust bearing. The bottom impellers in such a pump are permitted to float on the pump shaft so that thrust loads on the impellers are not transmitted to the shaft and vice versa. This bottom floater impeller design has been frequently employed in small diameter pumps, such as being run into deep wells, when it is not desired to impart heavy loads onto the thrust bearings which are limited in size by the small housing diameter available. However, when the operating depth of the well is such that the hydrostatic forces operating on the pump shaft become excessive, the small thrust bearing which is dictated by the small diameter pump housing is not able to withstand the thrust loads even though a portion of the shaft load is transferred to the pump housing by way of the fixed impellers on the shaft. Additionally, in the bottom floater system just described, as the bore hole depth increases, the down loading of the shaft which is transferred to the pump parts causes wear on the pump parts to the extent that the system is no longer practical.

These problems associated with wear to bearing surfaces created by such deep well pumps has in the past also been treated to a certain extent by the use of balancing hubs or the like which attempt to provide pressure balance on pump components so that friction surfaces which are caused to engage one another are placed as near as possible under balanced force conditions, to thereby minimize the frictional forces acting on such engaging surfaces. An example of this is shown in U.S. Pat. No. 2,809,590 to Brown which shows an electric motor driven pump wherein discharge pressures are rerouted back into the pump system to act upwardly on pump surfaces against which such discharge pressure are being imposed in order to generate a pressure balance and thus minimize wear forces acting on the relatively moving parts. This is done by providing a pressure balancing disk which is mounted on the pump shaft and internal pressure balancing passages are used to bring a fluid pressure differential to the balancing disk.

U.S. Pat. No. 4,793,777 to Havenstein shows a centrifugal pump including an axillary impeller arranged additionally to the pump impeller proper to provide for pressure reduction and a throttling device to bring about an equalization of thrust forces acting on the impeller.

Vitu U.S. Pat. No. 1,867,290 also describes a centrifugal pump wherein openings are provided in the impeller to permit the passage of at least part of the volume of the liquid being handled by the pump to the back side of the impeller in order to balance pressures on the two sides of the impellers.

Peterson U.S. Pat. No. 1,609,306 also shows a balancing disk for adjusting forces of a centrifugal well pump.

In each of the above systems an attempt is made to balance pressures acting on a surface by transmitting through some means the higher discharge pressures to lower pressure surfaces in the apparatus to thereby balance forces acting on the various parts. Some of these systems are rather simple and yet others are very complex, but in any event, they are not sufficient or practical to deal with the extremely high forces that are encountered in deep well operations contemplated by the present invention.

It is, therefore, an object of the present invention, to provide a new and improved pump system which will obviate the load problems occurring in deep wells having small diameter pumps by providing a net upthrust lifting force on selected impellers which upthrust is transmitted to the pump shaft to partially offset shaft forces acting down on the thrust bearing.

SUMMARY OF THE INVENTION

With this and other objects in view, the present invention contemplates a submersible pump for operating under high load conditions for pumping fluids against a large hydrostatic head by generating an upthrust force on pump impellers which is transferred to the pump shaft to offset the pump shaft thrust load.

This is accomplished by providing an upthrust impeller which rotates with the pump impeller in a chamber above the pump impeller, with the chamber having no inlet so that the chamber tends to be evacuated by movement of the upthrust impeller therein to create a low pressure region above the top of the impeller. Thus, the average pressure on the top side of the impeller is maintained at a level significantly below the average pressure on the bottom side to develop considerable upthrust on the impeller. These impellers are affixed to the pump shaft so as to transmit this upthrust to the shaft and thereby oppose the downward pump shaft thrust load resulting from hydrostatic head acting down on the area of the pump shaft.

DESCRIPTION OF THE PREFERRED EMBODIMENT

Figure 1:
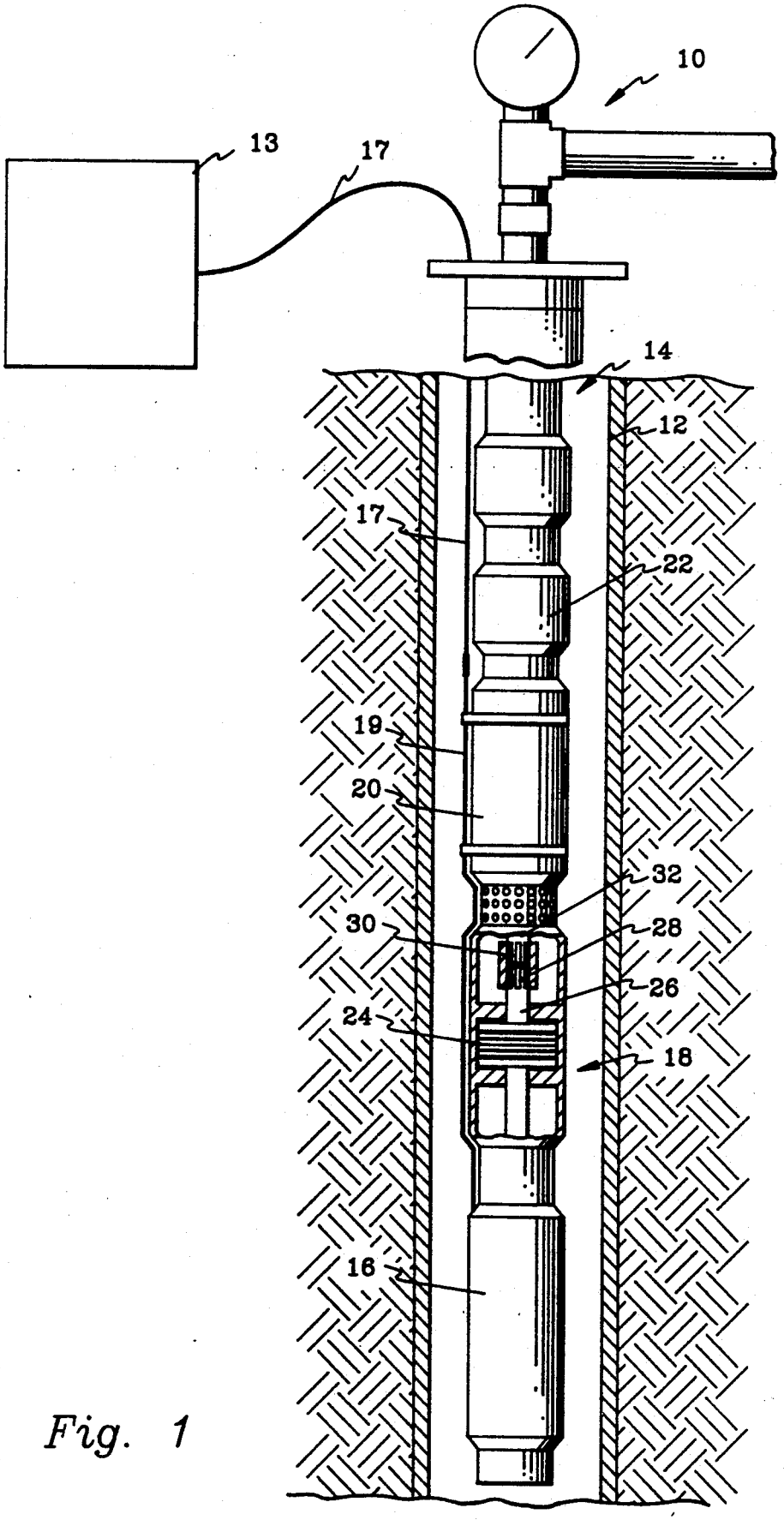
FIG. 1 is a cross sectional schematic view of an oil well production system showing an electrical submersible pump (ESP) suspended from a pipe string in a wellbore in accordance with the present invention.

Referring first to FIG. 1 of the drawings, a typical production system is depicted schematically having a well head 10 at the surface of a well for controlling the flow of fluids which are brought to the surface from underground formations. A well bore 12 is shown extending below the earth's surface with a pipe string 14 suspended therein having a motor section 16 at the lower end thereof. An electric cable 17 extends from a control system 13 at the surface along the pipe sting and connects with a motor lead extension 19 which extends upwardly from the motor section. A protector or seal section 18 is positioned between the motor 16 and pump housing 20. The protector section 18 serves to isolate the motor 16 from the well fluids. The protector section also functions as an oil reservoir for the motor and as a pressure equalizing chamber, allowing the internal pressure of the motor to match the ambient wellbore pressure. A thrust bearing 24 in the protector absorbs axial loading from the pump. Check valve 22 is shown in the tubing or pipe string above the pump housing 20. Thrust bearing 24 is mounted on a shaft 26. The upper end of the shaft 26 has a splined portion 28 which is arranged to engage and bear against a splined portion 30 formed on shaft 32 extending downwardly from the pump section in the pump housing 20. This is also shown schematically in FIG. 4 of the drawings.

Figure 2:
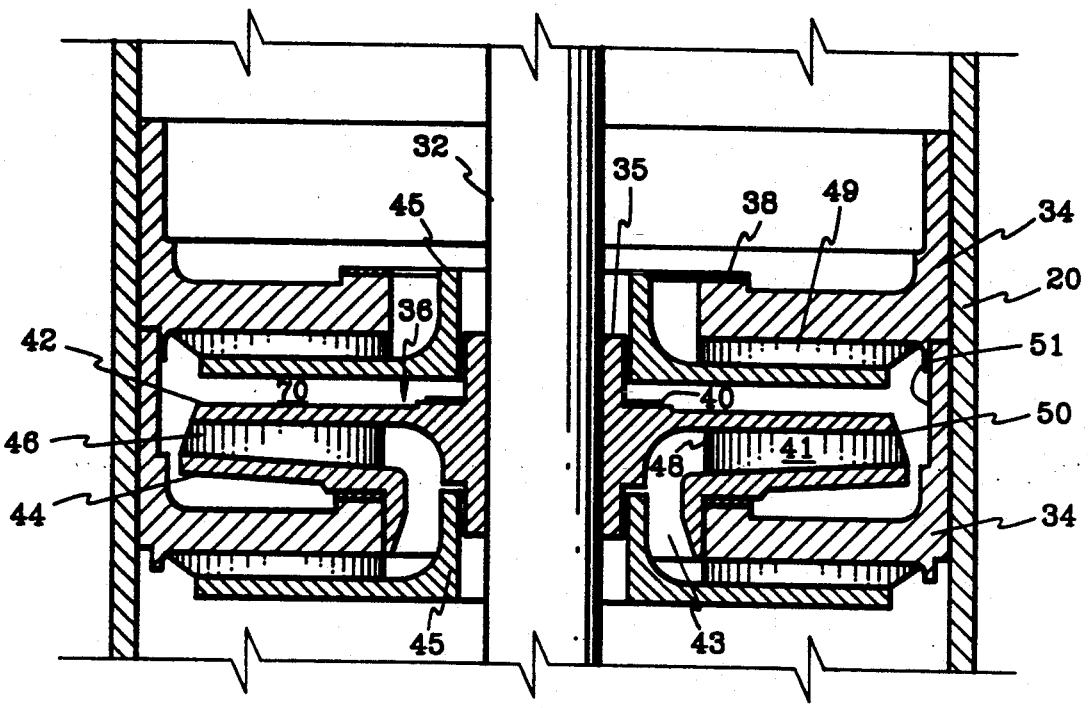
PRIOR ART Fig. 2
FIG. 2 shows a cross section of a typical radial flow ESP impeller and diffuser.

Next, referring to FIG. 2, a typical radial flow ESP impeller and diffuser are shown employing state-of-the-art features for use in a downhole pump system. A pump shaft 32 is shown axially positioned within the housing 20 of the pump. Diffusers 34 are shown positioned within the pump housing 20 and are stacked one upon the other in assembly therein. In a similar manner, impellers 36 extending from a hub 35 are shown positioned about the shaft 32. The impellers are normally mounted to move freely vertically upon the shaft 32, between adjacently stacked diffusers 34 positioned above and below each impeller. Thrust washers 38 and 40 are mounted on top bearing surfaces of the diffuser and impellers respectively, with thrust washer 38 being termed as diffuser pad or down thrust pad and washer 40 termed as an impeller pad or upthrust pad. Each of the impellers is comprised of a top shroud 42 and bottom shroud 44. Arcuately shaped vertical impeller vanes 46 are sandwiched between the top and bottom shrouds and extend radially outwardly between the top and bottom shrouds 42 and 44 to define radially extending passages 41 (see also FIG. 6). An eye or inlet 43 provides an inlet opening for fluids into each of the passages 41. An upwardly extending annular shoulder 45 is formed on the diffuser 34 and defines the inner wall of the eye 43 in conjunction with the impeller.

The passageway 41 is defined on its sides by the vanes 46 and on its top and bottom by shrouds 42 and 44 respectively. The passageway begins at an inner end 48 of the impeller vane 46 and ends at an outer end 50 of the vane 46. The inner end of the passageway 41 connects with the eye 43 and the outer end of the passageway distributes fluids being directed therethrough by centrifugal force towards a diffuser wall 51 The wall 51 serves to direct the fluids upwardly around the outer end of top shroud 42 and into a diffuser passageway 49 which is formed by top and bottom shrouds on the diffuser and a vane similarly to the impeller The diffuser passageway 49 feeds the fluids inwardly toward the eye 43 of the next upwardly adjacent impeller. This flow process then continues through adjacent stages of impellers and diffusers until a sufficient pressure is imparted to the fluids to carry them to the surface.

Figure 3:
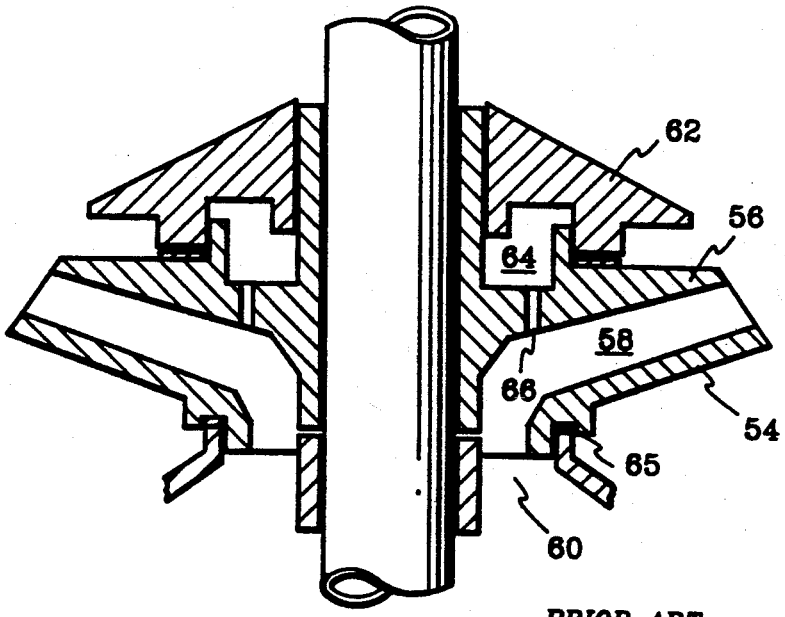
PRIOR ART Fig. 3
FIG. 3 shows a cross section of a typical mixed flow ESP impeller embodying a balancing hub.

Referring next to FIG. 3 of the drawings an impeller is shown in cross-section which depicts a typical mixed flow ESP impeller component. The impeller is shown having a bottom shroud 54 and top shroud 56 which together with radial vanes (not shown) define a passageway 58. An eye 60 serves as an entrance to the passageway which directs fluids upwardly at an angel toward the next upwardly adjacent diffuser (not shown) which in turn has a passage that directs the fluids to the next impeller eye. The impeller stage of FIG. 3 is provided with a balancing hub 62 between the impeller and the next above adjacent diffuser. The hub 62 is shaped to define an annular chamber 64 above the top shroud 56 of the impeller. A port 66 is formed transversely through the top shroud 56 to provide a fluid communication path between the passageway 58 near its eye 60 and the annular chamber 64. As fluid moves from the eye of an impeller through the passageway 58 to the diffuser at the end of passageway, pressure in the impeller passageway increases with each impeller stage incrementally increasing the pressure of the fluid as it flows upwardly through the pump stages. Therefore, in any one stage the pressure at the eye of the impeller is less than the pressure at the exit of the passageway 58 of that impeller. The port 66 thus communicates the chamber 64 with the lower pressure from eye 60. The remainder of the upper surface of top shroud 56, of impeller outside the chamber 64, is subjected to the discharge pressure from passage 58. This communication of low pressure (suction pressure) fluids to the topside of the impeller provides for an equalization of pressure between the eye (suction) and a portion of the top of the impeller so that down thrust forces acting on a thrust washers 65 is minimized. The thrust washer 65 is positioned between the bottom impeller shroud and the adjacent diffuser.

Figure 4:
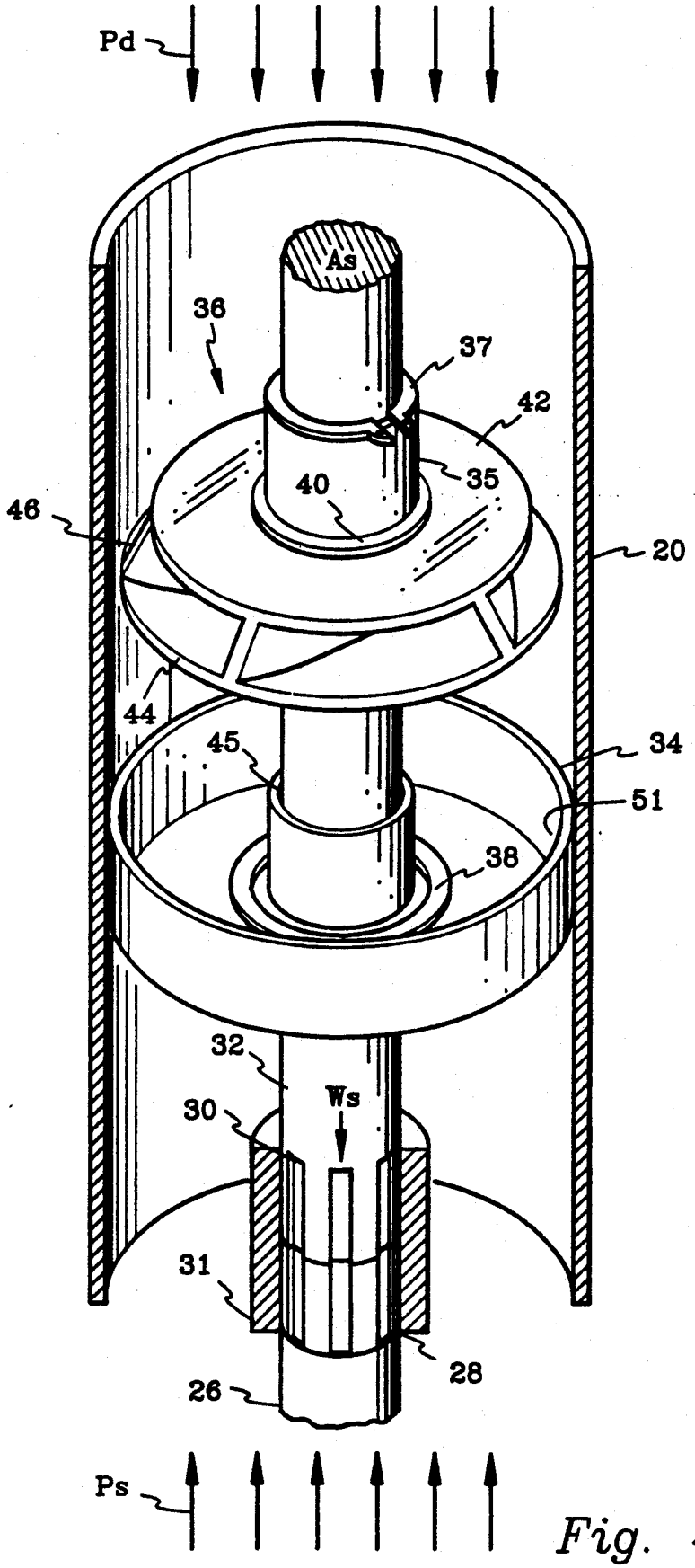
FIG. 4 is a perspective view of a pump shaft having an impeller fixedly mounted thereon by a snap ring in accordance with the present invention and graphically showing the loads imposed upon the pump parts.

Reference is next made to FIG. 4 of the drawings where an impeller and diffuser are shown in a perspective, partially exploded view, and with arrows representing forces acting on these pump parts. The pump housing 20 contains the vertical pump shaft 32 upon which is mounted the impeller 36 which rotates with shaft 32. The diffuser 34 which is supported by the housing 20 includes the vertical wall portion 51 which nests about the outer peripheral edge portions of impeller 36. The lower end of shaft 32 is shown having splines 30 thereon which engage with a coupling 31 to hold the shaft 32 in engagement with a splined portion 28 of a shaft extending upwardly from the protector section 18 (FIG. 1).

The arrows $P_d$ at the top of FIG. 4 graphically represent the discharge pressure of the pump which is imparted to the top of cross-sectional area $A_s$ of the shaft 32. Arrows $P_s$ at the bottom of FIG. 4 represent the suction pressure which impinges on the bottom of the shaft 32. The weight of the shaft 32 is represented by the arrow $W_s$ near the lower splined end 30 of the shaft. The impellers on an ESP are typically free floating so that axial thrust forces on the impellers are not borne by the shaft 32. Thus in such a typical pump, the total shaft thrust is equal to the weight of the shaft plus the forces acting on the cross-sectional area of the shaft:

$$\text{Shaft Thrust} = W_s + A_s(P_d - P_s) \quad \text{(Equation 1)}$$

In the bottom floater design of pumps, some of the top impeller stages have the impeller fixed against relative vertical movement on the pump shaft, so that down thrust loads on the shaft are actually transferred to the impeller and since the impellers and diffusers bear against one another, these shaft thrust forces are transferred to the diffuser stack and the pump housing 20. When it is described herein that the impeller is fixed to the shaft to prevent relative vertical motion, or that relative longitudinal movement between the impeller and shaft is restricted, it is understood that the intention is to provide a means to transmit any upthrust on the impeller to the shaft. Thus, some vertical motion may occur and still accomplish this goal.

Figure 5:
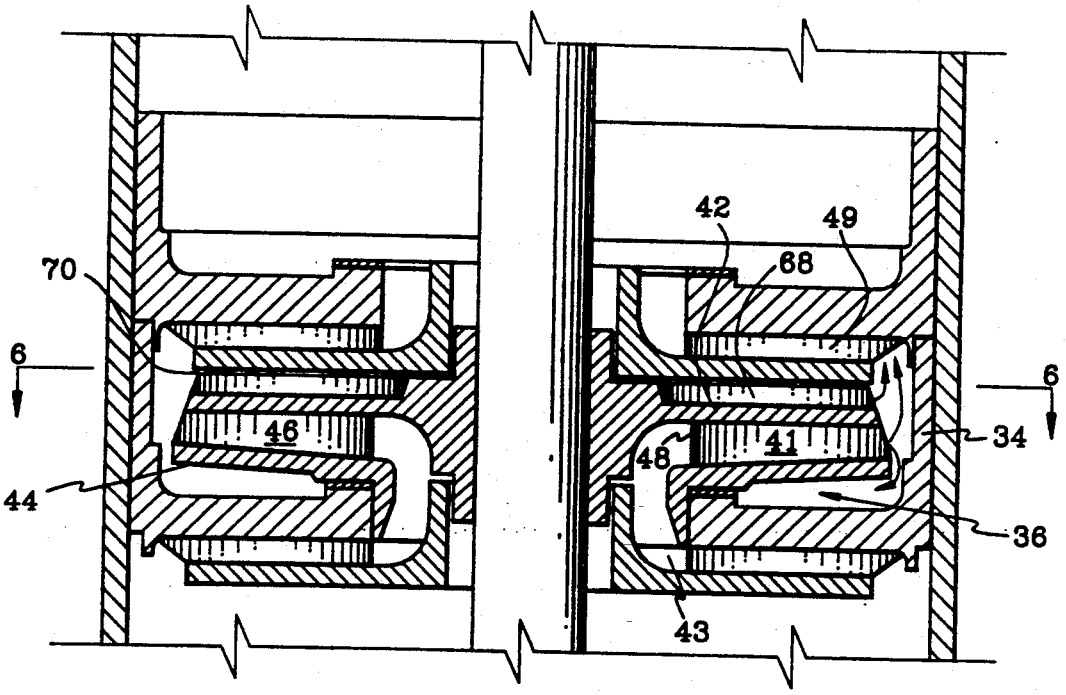
FIG. 5 is a cross sectional view of an upthrust generating impeller and associated diffusers in accordance with the present invention.
Figure 6:
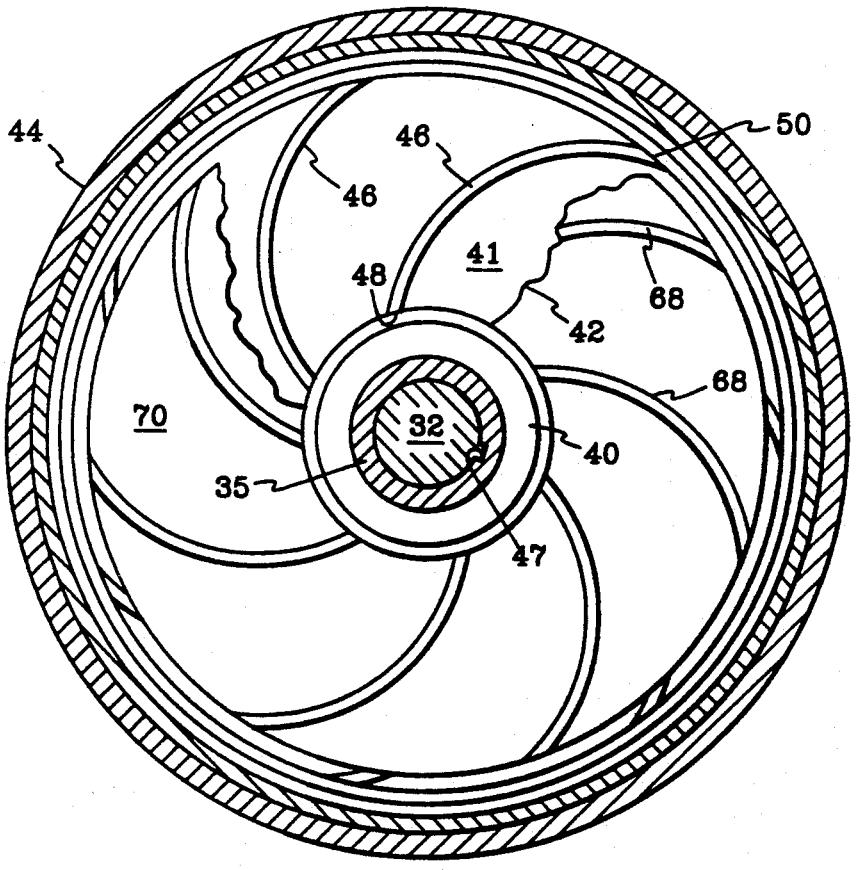
FIG. 6 is a plan view in cross-section taken along the lines 6—6 of FIG. 5 showing the upthrust generating impeller and cut away in portion to show the interior passages in the pump impeller.

FIGS. 5 and 6 of the drawings shows an improvement in accordance with the present invention wherein the typical pump stage of FIG. 2 is modified to provide a series of radially extending, arcuate, open impeller vanes 68 which extend vertically upwardly in the form of a ridge above the top shroud 42. These vanes 68 when rotated with the impeller, sweep through a chamber formed by the space 70 between the top shroud 42 and the bottom of the next above adjacent diffuser. The space or chamber 70 has no fluid communication path at its inner end and thus forms a blind space so that as the arcuate vanes 68 are turned, the vanes sweep out the space 70 trying to force fluids therein into the stream of fluids passing from the impeller passage 41 upwardly toward the diffuser passage 49 thereabove, as depicted by the arrows in FIG. 5. This sweeping of the fluids in space 70 causes a pressure reduction to take place so that pressure in chamber 70 is lower than the pressure on the bottom side of the lower shroud 44 on impeller 36 to thereby provide a net upthrust on the impeller. The space below the impeller between the bottom shroud 44 and the diffuser therebelow communicates with the outlet pressure at the end 50 of the impeller vane 46. This then provides a substantial pressure differential acting across the impeller area.

Figure 7:
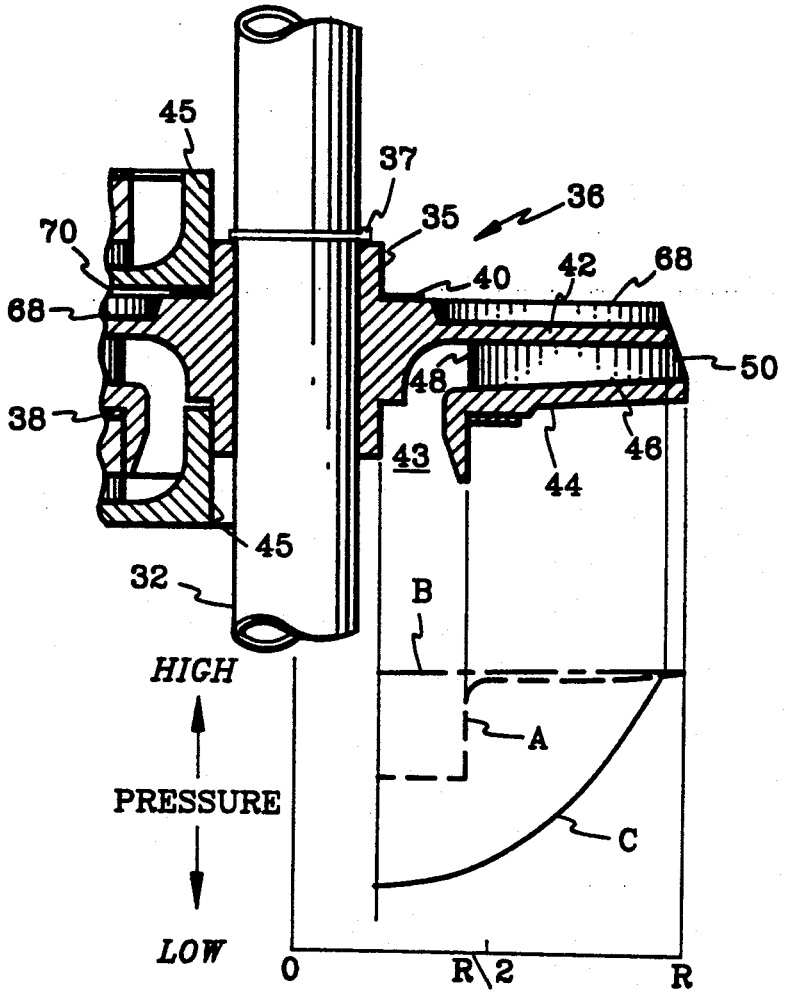
FIG. 7 shows a partial cross-section of the upthrust generating impeller of FIG. 5 together with a chart showing pressure distributions on the top and bottom sides of the upthrust generating impeller compared to pressure distributions on a regular pump impeller.

FIG. 7 graphically shows the effect of this differential pressure being imposed on the impeller as a result of the upthrust generator. An impeller 36 is shown having top and bottom shrouds 42 and 44 respectively, and an impeller vane 46 separating the space between the shrouds into impeller passage 41. The upthrust vane 68 extends vertically upwardly from the top shroud 42 into blind chamber 70 between the top shroud 42 and the bottom of an upwardly adjacent diffuser 34 (not shown). The graph shown below the impeller plots pressure exerted on the exterior of the impeller on the vertical scale against radial distance from the centerline of shaft 32 on the horizontal scale. The bottom side area of the impeller is composed of the eye area and the bottom shroud area. It is seen from line A on the graph that the pressure on the bottom side of the impeller 36

(dotted line) is lowest at the eye or inlet 43 to the impeller. This inlet pressure is also known as the suction pressure. It may seem that the bottom side area of bottom shroud 44 is subjected to essentially discharge pressure at outlet end 50 of vane 46 which is demonstrated by the sharp vertical rise in line A from the suction pressure to the essentially discharge pressure. For an impeller not utilizing the upthrust vane 68 the pressure on the upper surface of top shroud 42 would be as shown in line B which is substantially equal to the outlet pressure from the impeller vane 46. However, in an impeller provided with the open vane upthrust impeller 68 on the top shroud 42, the top side pressure is shown at line C as being considerably less than even the suction pressure on the impeller, with such top side pressure gradually building as the radius approaches the outlet end of the impeller passage 41. This reduced pressure on the top side of the impeller thus provides an upward thrust acting on the impeller surfaces to lift the impeller upwardly. When this impeller is fixed to the shaft 32 the upthrust is transferred to the shaft to provide a lifting force on shaft 32.

The downward force which is exerted on the ESP shaft 32 is the product of the total pump head, the fluid gradient and the shaft area.

$$\text{Shaft Downthrust} = \text{Head} \times \text{Gradient} \times \text{Shaft Area}$$
(Equation 2)

Most pumps of 5.13 inches OD and smaller, have all floating impellers. Thus, the shaft axial load is totally supported by the thrust bearing 24 in the Protector section 18. Prior to this invention, in pump applications where a high head is encountered such as in deep well situations, the most common design expedient for dealing with high axial loads on the pump shaft is to have the upper approximately 40 percent of impellers axially fixed to the shaft so that a portion of the shaft thrust load is transferred to the thrust absorbing washers of the pump stages and thereby to the diffusers and housing 20, to avoid exceeding the thrust bearing capacity of the pump.

Two factors that currently limit the maximum depth at which ESP's may be operated are (1) shaft torque and thus horsepower, and (2) pump shaft thrust load. An obvious way of increasing shaft torque capacity is to design pumps with larger diameter shafts. However, this solution to the torque limitation problem magnifies the thrust load problem in that shaft cross-sectional area is a direct factor in the thrust loading on shaft, as is pumping depth. (See equation 2 above).

Thus, shaft loads are compounded as pump depth increases and at some point these shaft loads will result in forces exceeding thrust bearing capabilities. While the fixed impeller design for the upper stages will help to alleviate this problem by transferring shaft load to the pump stages and thus to the thrust washers therein, this thrust load transferred to the pump stages may exceed the thrust absorbing capacity commensurate with acceptable pump life. By utilizing the upthrust impeller of the present invention, sufficient upthrust will be generated to cancel the effect of a majority of this transferred thrust loading from the shaft thus minimizing thrust loading on the stages and on the thrust bearing.

In the operation of the upthrust impeller system described herein, the pump is arranged to include a series of stages, most likely in the upper portion of the pump, wherein the impellers are fixed to the shaft. This fixing of impellers includes a rotational fix by means of keyway 47 (FIG. 6) and key (not shown), and a longitudinal fix by means of snap ring 37 (FIG. 4). It is again emphasized that the longitudinal fix is for the purpose of transferring impeller upthrust to the shaft and may be accomplished by other means. The lower pump stages are fixed rotationally but are free floating longitudinally. In this upthrust arrangement, when the pump is rotated by means of a drive shaft 32 connected with the pump motor 16, fluids are pulled into an intake at the lower end of pump housing 20. These fluids are directed into the lower free floating pump stages through the impeller eye or inlet 43 where they are then contacted by the inner end 48 of impeller vane 46. The arcuate impeller vanes impart a centrifugal force to the fluids as the fluids move to the outer end 50 of the vane 46. A diffuser wall 51 then serves to turn the fluids upwardly into a channel formed by vanes in the diffuser section which serves to direct the fluids toward the center of the pump where they are picked up by the inlet 43 of the upwardly next adjacent impeller of the next stage. In each stage as just described, the fluid pressure will be incrementally raised, say 15 psi in a typical application, with enough stages being employed in the pump to overcome the total head to thereby cause the well fluids to be pumped to the surface through the production pipe string 14. In the lower free floating pump stage just described, the forces acting on the impeller are represented in FIG. 7 by the pressure profile lines A and B. The bottom surface pressure (represented by line A) is shown starting at the eye or inlet 43 where the pressure level will be nearly the same as the exit pressure of the previous stage. The pressure acting on the lower surface of shroud 44 is substantially the much higher pressure existing at the exit of the impeller passage 41. The forces acting on the top surface of the standard impeller, such as the impeller of FIG. 2, are shown at line B as being substantially at the high pressure generated at the outlet end 50 of the vane 46. Thus, the product of effective pressure times area acting on the topside of impeller 36 exceeds that acting on the bottom side. Therefore, the pressure forces acting on the impeller results in a net downthrust which is the difference between forces represented by lines A and B.

In accordance with the present invention, as the fluids progress upwardly in the pump to the upper stages, the impellers will be arranged so that they are fixed against relative longitudinal movement with shaft 32 and they are provided with an upthrust open vane 68. This upthrust impeller vane 68 is effective to sweep the chamber 70 formed between the impeller and adjacent diffuser to thereby generate a low pressure in chamber 70. The forces acting on the upthrust impeller are represented by pressure profile lines A and C of FIG. 7. The inlet or eye pressure is substantially the same as in the regular impeller with the suction pressure being that of the outlet pressure of the previous stage. Also, the bottom shroud 44 of the impeller is subjected to the outlet pressure of the impeller passage 41 found at the outlet end 50 of the impeller vane. The forces operating downwardly against the upper surface of top shroud 42 however are drastically affected by the operation of open impeller 68 sweeping the chamber 70 to develop a considerable pressure drop as represented by line C in the pressure graph associated with FIG. 7. Thus, the net force acting on the upthrust impeller is the resultant of pressures depicted by lines A and C, times the areas of the impeller surface being acted on. The result is an upthrust force on the impeller which is transmitted to the shaft 32 through the hub 35. Hub 35 is held against relative vertical movement by retaining ring 37. Although the upthrust impellers which are fixed to shaft 32 develop a net upthrust which is applied to shaft 32, the impellers as part of the total pump system are operated in a light to moderate downthrust because of the magnitude of the total shaft thrust load. Thus, being attached to the shaft under a net downthrust, these fixed impellers will not be carried upwardly to engage the diffuser above.

While particular embodiments of the present invention have been shown and described, it is apparent that changes and modifications may be made without departing from this invention in its broader aspects, and therefore, the aim in the appended claims is to cover all such changes and modifications as fall within the true spirit and scope of this invention.

We claim:

1. A multi-stage centrifugal submersible pumping apparatus for pumping well fluids from the bottom of a wellbore to the surface, comprising:

generally cylindrical pump housing means;

shaft means axially positioned within said housing means and mounted for rotation relative thereto;

a plurality of impeller assemblies mounted on said shaft means in vertically spaced relation for rotation therewith and having a plurality of vanes radially extending from near the shaft means toward the housing means to form impeller passages having an inlet end near the shaft means and an outlet end near the housing means;

top shroud means covering the top of the impeller passages, said top shroud means having an outer upper surface formed on the top side of said top shroud means;

bottom shroud means covering the bottom of the impeller passages;

a plurality of diffuser means on said housing positioned above and below said impeller assemblies and spaced therefrom to form a partially enclosed chamber in the space between said top shroud on said impeller assembly and an adjacent diffuser means spaced thereabove, said diffuser means having diffuser passages for directing fluids form the outlet end of said impeller passages to the inlet end of said impeller passages in an upwardly adjacent stage; and open impeller means on at least a portion of said impeller assemblies and extending upwardly from the outer upper surface of said top shroud means for moving fluids from said chamber between said impeller assembly and said adjacent diffuser means thereabove to thereby generate a relatively low pressure within said chamber when said impeller assembly is rotated relative to said diffuser means for applying a net upthrust force to said impeller assembly having said open impeller vane.

2. The pumping apparatus of claim 1 wherein said portion of said impeller assemblies include an inner hub for mounting said assembly on said shaft and means for substantially fixing said hub against relative vertical movement on said shaft.

3. The pumping apparatus of claim 1 wherein said diffuser means includes an outer hub having top and bottom surfaces for engaging the hubs of diffuser means in adjacent stages and with said diffuser passages extending from said hub radially inwardly toward said shaft.

4. The pumping apparatus of claim 1 wherein said impeller assemblies having open impeller means thereon are affixed to said shaft means in such a way as to substantially prevent relative longitudinal motion so that said upthrust force is applied to said shaft means.

5. The pumping apparatus of claim 1 wherein at least some of said impeller assemblies are mounted for relative vertical movement on said shaft.

6. Centrifugal downhole submersible pumping apparatus for pumping well fluids from a relatively deep wellbore to the surface wherein a multi-stage impeller pump is suspended on a production tubing, comprising:

a pump housing enclosing a multi-stage pump having a series of spaced apart pump impellers, one above the other, said impellers each having enclosure means including top and bottom shrouds forming a plurality of impeller passageways having an inlet and outlet, for imparting a centrifugal force to fluids moving through said pumping apparatus;

shaft means axially positioned within said pump housing, said impellers mounted on and arranged for rotation with said shaft means;

a series of diffusers mounted on said housing and arranged so that one of said diffusers extends between each of said spaced apart impellers for directing the flow of fluids from the outlet of one impeller upwardly through said pump to the inlet of the next above impeller;

upthrust means extending upwardly from said enclosure means top shroud on a selected portion of said impellers for lowering the pressure of fluids acting on the upper surface of said enclosure means top shroud to a level necessary to provide an upthrust force on said impeller, and means for mounting said impellers having said upthrust means on said shaft means to transfer upthrust from said impeller to said shaft.

7. The apparatus of claim 7 wherein said upthrust means on said selected portion of said impellers is arranged to lower the pressure of fluids acting on the top surface of said enclosure means to a level that is less than the pressure of fluid exiting said impeller which are acting on the bottom surface of said enclosure means to thereby generate a net upthrust on said impeller.

8. The apparatus of claim 7 and further including thrust bearing means for engaging and supporting said shaft means, said shaft means being subject to hydrostatic loads applied to the upper end of said shaft, said pumping apparatus being further arranged so that another portion of impellers mounted on said shaft means are mounted free floating to move longitudinally with respect to said shaft means so that loads imposed upon said shaft means are not carried by such free floating impellers, such another portion of said impellers each having a top surface devoid of said upthrust means.

9. The apparatus of claim 8 wherein said selected portion of said impellers having upthrust means carry at least a portion of the hydrostatic load on said shaft so that upthrust forces on such selected portion of said impellers opposes the at least a portion of the load of said shaft.

10. A multi-stage centrifugal downhole pumping apparatus for pumping well fluids from the bottom of a wellbore to the surface, comprising;

a pump housing having a vertical shaft axially mounted for rotation therein, an impeller in each of a series of pump stages mounted for rotation with said shaft, a selected number of said impellers being arranged to move freely longitudinally on said shaft while the remainder of said impellers are mounted fixedly on said shaft to restrict longitudinal motion relative thereto, and means on at least part of said fixedly mounted impellers for developing an upthrust on said impeller when said impeller is in rotational motion to transfer said upthrust to said shaft.

11. The apparatus of claim 10 wherein said upthrust means is in the form of an open vane arranged for movement in a partially enclosed space above said impeller to generate a reduced pressure in said enclosed space.

12. The apparatus of claim 11 and further including top and bottom shrouds on said impeller in each stage to enclose a passageway in the impeller, such impeller having an arcuate shaped vane between the top and bottom shrouds and extending radially from the impeller toward an inner wall of said pump housing, and wherein said upthrust developing means is in the form of an open vane extending upwardly from said top shroud.

13. The apparatus of claim 12 wherein said open vane has an arcuate shape and extends radially from a place on said top shroud which is near to said shaft in a direction toward said inner wall of said housing.

14. The apparatus of claim 12 wherein said impellers in each pump stage are spaced apart vertically and further including diffuser means on said housing and extending into the space between said impellers, said diffuser having a bottom surface defining a cavity between said diffuser and the top shroud of the impeller position below the diffuser.

15. The apparatus of claim 14 wherein upon rotation of said selected number of said impellers, said open vane on said selected number of said impellers sweeps through said cavity to generate a low pressure within said cavity and thereby imparts a lifting force to said shaft.

16. A multi-stage electrically driven downhole centrifugal submersible pumping apparatus for pumping well fluids from a relatively deep and small diameter wellbore to the surface, comprising;

a pump housing;

a vertical shaft mounted for rotation within said housing, said shaft arranged to have downwardly directed vertical loads on said shaft supported by a thrust bearing operably connected to the shaft, such vertical loads on said shaft resulting from the weight of said shaft and any pump parts supported thereon and from hydrostatic forces resulting from the weight of well fluids acting on the cross-sectional area of said shaft;

impeller means mounted on said shaft for rotation therewith for pumping well fluids upwardly through said housing;

upthrust generating means on said impeller means for generating a net upthrust on the surfaces of said impeller means; and means for transmitting upthrust loads on said impeller means to said shaft.

17. The apparatus of claim 16 wherein those impeller means having upthrust generating means thereon are affixed to said shaft to prevent unrestricted relative longitudinal movement of said shaft and said impeller means.

18. The apparatus of claim 17 wherein said apparatus includes a plurality of impellers means having no upthrust generating means thereon and which are mounted on said shaft for relative vertical movement therewith.

* * * * *

UNITED STATES PATENT AND TRADEMARK OFFICE

CERTIFICATE OF CORRECTION

PATENT NO. : 5,201,848

DATED : April 13, 1993

INVENTOR(S) : Maston L. Powers

It is certified that error appears in the above-identified patent and that said Letters Patent is hereby corrected as shown below:

Column 10, Claim 7, line 40, "7" should be --6--.

Column 10, Claim 8, line 47, "7" should be --6--.

Column 11, Claim 12, line 16, "11" should be --10--.

Signed and Sealed this

Twenty-eighth Day of December, 1993

*Attest:*

Bruce Lehman

BRUCE LEHMAN

*Attesting Officer*

*Commissioner of Patents and Trademarks*